US006226961B1

(12) United States Patent
Gordon

(10) Patent No.: US 6,226,961 B1
(45) Date of Patent: May 8, 2001

(54) CLEANING ARTICLES

(76) Inventor: Gigi C. Gordon, 453 N. Aberdeen, Chicago, IL (US) 60622

( * ) Notice: Subject to any disclaimer, the term of this patent is extended or adjusted under 35 U.S.C. 154(b) by 0 days.

(21) Appl. No.: 09/131,123

(22) Filed: Aug. 7, 1998

(51) Int. Cl.[7] ..... B65B 61/20
(52) U.S. Cl. ..... 53/445; 15/244.4
(58) Field of Search ..... 40/586, 635; 15/244.1, 15/244.4, 244.3; 53/445

(56) References Cited

U.S. PATENT DOCUMENTS

| | | | | |
|---|---|---|---|---|
| 1,975,451 | | 10/1934 | Dunaway . | |
| 2,165,420 | | 7/1939 | Seifert . | |
| 2,204,202 | | 6/1940 | Zimmerman . | |
| 2,423,435 | * | 7/1947 | Block | 40/635 X |
| 3,137,880 | * | 6/1964 | Kubit et al. | 15/244.1 |
| 3,936,384 | * | 2/1976 | Williams | 40/635 X |
| 4,081,394 | * | 3/1978 | Bartley | 40/635 X |
| 4,297,228 | * | 10/1981 | Kamada et al. | 40/635 X |
| 4,841,653 | | 6/1989 | Negley . | |
| 5,191,979 | | 3/1993 | Nemeroff . | |

OTHER PUBLICATIONS

Scotch–Brite (TM) Scour Pads with indica on pad; 3M; 1995.
Child's cleansing mitt for the bath with rabbit face.

* cited by examiner

*Primary Examiner*—Peter Vo
*Assistant Examiner*—Louis Huynh
(74) *Attorney, Agent, or Firm*—Price Heneveld Cooper DeWitt & Litton

(57) ABSTRACT

An identification system for identifying individual cleaning articles one from another includes a number of separate cleaning articles, each of the cleaning articles being intended for a different specific intended cleaning application. Each is provided with a cleaning surface disposed on an external surface for the specific intended application. An identifying indicia is disposed on the external surface for identifying the cleaning articles one from another and for identifying the specific intended application of the cleaning article from the specific intended application of each of the cleaning articles.

1 Claim, 5 Drawing Sheets

CLEANING ARTICLES

FIELD OF THE INVENTION

The present disclosure relates to a system for identifying cleaning articles for cleaning surfaces. More particularly, the present disclosure teaches an identification system for cleaning articles, such as a sponge, for a wide range of applications whereby an indicia relating to the intended application is provided to more readily identify the cleaning article and its intended application.

BACKGROUND OF THE INVENTION

The utility of cleaning articles as used in the home, in businesses and elsewhere is well known. Such cleaning articles, such as sponges and wipes, are used in a wide variety of different, and often conflicting, cleaning applications. For example, such cleaning articles are commonly used for relatively sanitary cleaning applications, such as cleaning dishes, glassware, cooking pots and pans, kitchen countertops, kitchen cabinets, kitchen sinks, dining tables and other surfaces and items that come into contact with food or are used during the food preparation process.

Yet virtually identical cleaning articles are also commonly used for other and often dramatically less sanitary and hygienic cleaning applications, such as bathroom toilets, bathroom tubs, bathroom sinks, floors, walls, cars, boats and windows. Interchanging these applications obviously is undesirable, and possibly dangerous, owing to the buildup and retention of bacteria in such cleaning articles, particularly in the first application. Thus, users do not wish nor should they use the same cleaning articles to wash sanitary and non-sanitary applications.

Moreover, consumers also occasionally desire a ready and apparent means of identifying cleaning articles for use with specific tasks, such as waxing furniture, that ought not be used for other purposes, such as naptha used to clean wood surfaces. Also, certain cleansers contain chemicals that do not interact well with chemicals contained in other cleansers, for example, ammonia and chlorine bleach. Quickly identifying the purpose for which the cleaning article has been used in the past or is to be used as intended can help avoid such undesirable interactions.

Accordingly, to provide a solution to these problems, it is desirable that there be cleaning articles that can be readily identified as appropriate for a particular application and that are provided with a visual indicia indicating such particular application. Although in the past color, size and materials of the cleaning articles themselves were the key features used to identify cleaning articles, it is not uncommon that otherwise identical cleaning might be encountered, each having a very different intended application or the intended application for that specific cleaning article may have been forgotten.

In sum, an identification system for positively identifying individual cleaning articles for their specific intended cleaning application was needed.

SUMMARY OF THE INVENTION

To overcome these and other disadvantages of the prior art, the present disclosure, briefly described, provides, in general form, an identification system for identifying individual cleaning articles comprising a plurality of cleaning articles, each of the cleaning articles having an external surface. A cleaning surface is disposed on the external surface intended for a specific application. Identifying means for identifying the specific intended application is applied to the cleaning article. Each of the plurality of cleaning articles is intended for a different specific intended application.

The identifying means can take several forms. It can be typed text affixed to the external surface of each of the plurality of cleaning articles, with the typed text corresponding to the specific intended application. The identifying means can be an identifiable symbol affixed to the external surface of each of the plurality of cleaning articles, the identifiable symbol corresponding to the specific intended application and being of a visual or tactile nature. The identifying means can also be an identifiable shape formed by the outer periphery of each of the plurality of cleaning articles, where the outer periphery corresponds to the specific intended application.

As will appear from the detailed description of the preferred embodiment to follow, the features of the cleaning articles render them suitable for a wide variety of conditions and uses. In addition to the convenience of rendering a plurality of cleaning articles quickly identifiable for their intended application, particularly where such applications include widely divergent applications such as dishes and bathroom floors, significant safety and health benefits are obtained from the present invention.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto.

In this respect, before explaining the several preferred embodiments of the disclosure in detail, it is to be understood that the disclosure is not limited in its application to the details of the construction and the arrangements set forth in the following description or illustrated in the drawings. The identification system for cleaning articles of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

Therefore, it is the primary object to provide a new and improved identification system for identifying individual cleaning articles.

A further object is to provide an identification system for a plurality of cleaning articles, each of which has a specific intended application Another object is to provide a readily identifiable identifying means on each of a plurality of cleaning articles for identifying the specific intended application of the cleaning article.

An additional object is to provide an identification system that lessens the likelihood of accidental interchange between a cleaning article intended for a sanitary application and a cleaning article intended for a less sanitary application.

A still further object is to provide an identification system that is inexpensively and easily applied to cleaning articles.

Yet another object is to provide an identification system that comprises textual material.

A further object is to provide an identification system that comprises different shapes for each of a plurality of cleaning articles, each shape corresponding to a different application.

An additional object is to provide an identification system that comprises different symbols for each of a plurality of cleaning articles, each symbol corresponding to a different application.

These and other objects, along with the various features and structures that characterize the invention, are pointed out with particularity in the claims annexed to and forming a part of this disclosure. For a better understanding of the identification system for cleaning articles of the present disclosure, its advantages and the specific objects attained by its uses, reference should be had to the accompanying drawings and descriptive matter in which there are illustrated preferred embodiments of the invention.

BRIEF DESCRIPTION OF THE DRAWINGS

The disclosure of the identification system for cleaning articles is explained with illustrative embodiments shown in the accompanying drawing, where.

DETAILED DESCRIPTION OF THE PREFERRED EMBODIMENT

Figure 1:
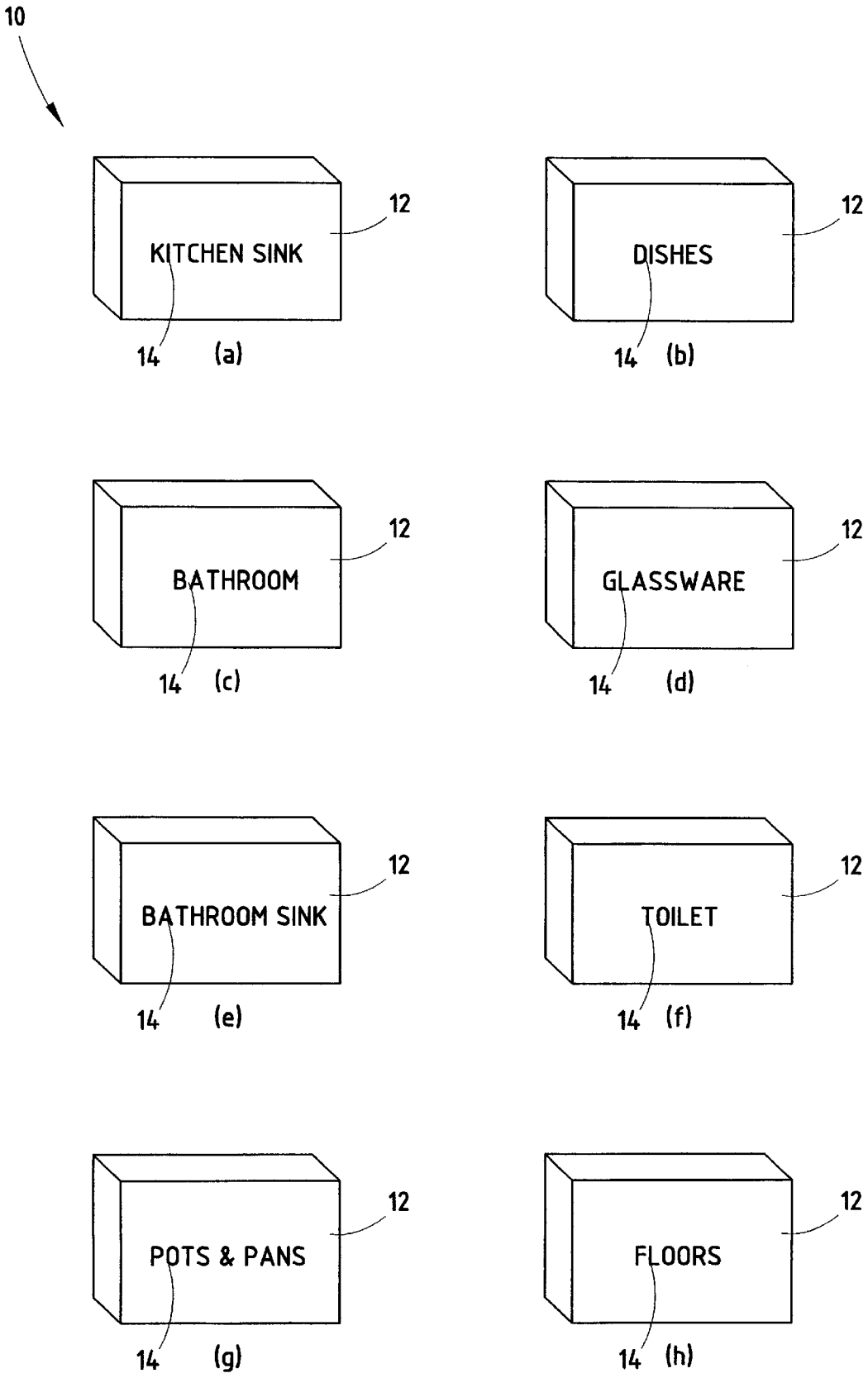
FIGS. 1(*a*)–1(*h*) are perspective views of a first embodiment of the identification system for cleaning articles according to the present invention.

The best mode for carrying out the invention is presented in terms of the preferred embodiment, wherein similar reference characters designate corresponding features throughout the several figures of the drawings. As used herein, the term "cleaning article," whether singular or plural, is intended to refer to, and to be used interchangeably with, wiping and/or absorbent devices in any form, including, but not limited to, sponges, wipes, towels, rags, cloths, blotters and metallic and non-metallic scrubbers.

Referring now to the drawings, particularly FIG. 1, there is shown a first embodiment of the disclosed identification system 10 for cleaning articles 12 according to the present invention. As noted above, the cleaning articles 12 can be fabricated from any of a wide variety of materials, such as sponges, wipes, towels, rags, cloths and blotters. However, it is contemplated herein that the preferred base material for the cleaning article 12, having the greatest contemplated range of application, would be a sponge-like material.

Each of the cleaning articles 12 is intended for a specific and, according to the preferred embodiment, a different cleaning application. For example, the cleaning article 12 shown in FIG. 1(*a*) would be intended for use in the kitchen sink, while the cleaning article 12 shown in FIG. 1(*c*) would be intended for use in the bathroom. Each of the cleaning articles 12 is provided with an indicia formed of textual material 14 that is specific and unique to its intended application. Thus, in the preferred embodiment, the cleaning article 12 of FIG. 1(*a*) is provided with textual material spelling out the words "KITCHEN SINK," with the cleaning article 12 of FIG. 1(*c*) bearing the textual material "BATHROOM."

Similarly, indicia in the form of textual material 14 can be provided on a number of different cleaning articles 12, each having a unique, separate and in many cases mutually incompatible cleaning application. Thus, as shown in FIG. 1, the cleaning articles 12 bear the textual material: "KITCHEN SINK;" "DISHES;" "BATHROOM;" "GLASSWARE;" "BATHROOM SINK;" "TOILET;" "POTS & PANS;" and "FLOORS." Other textual messages, indicating other cleaning applications, can be determined and provided on the cleaning articles 12 as warranted.

As can be seen from FIG. 1, it is now possible for the first time to confidently and accurately identify the purpose for which a cleaning article 12 is intended, and importantly, how that particular cleaning article 12 may have been used in the past. For example, it is no longer necessary to guess which of a number of otherwise identical sponges may have been used to clean the floors when in fact the user is looking for the sponge to use in cleaning dishes.

Figure 2:
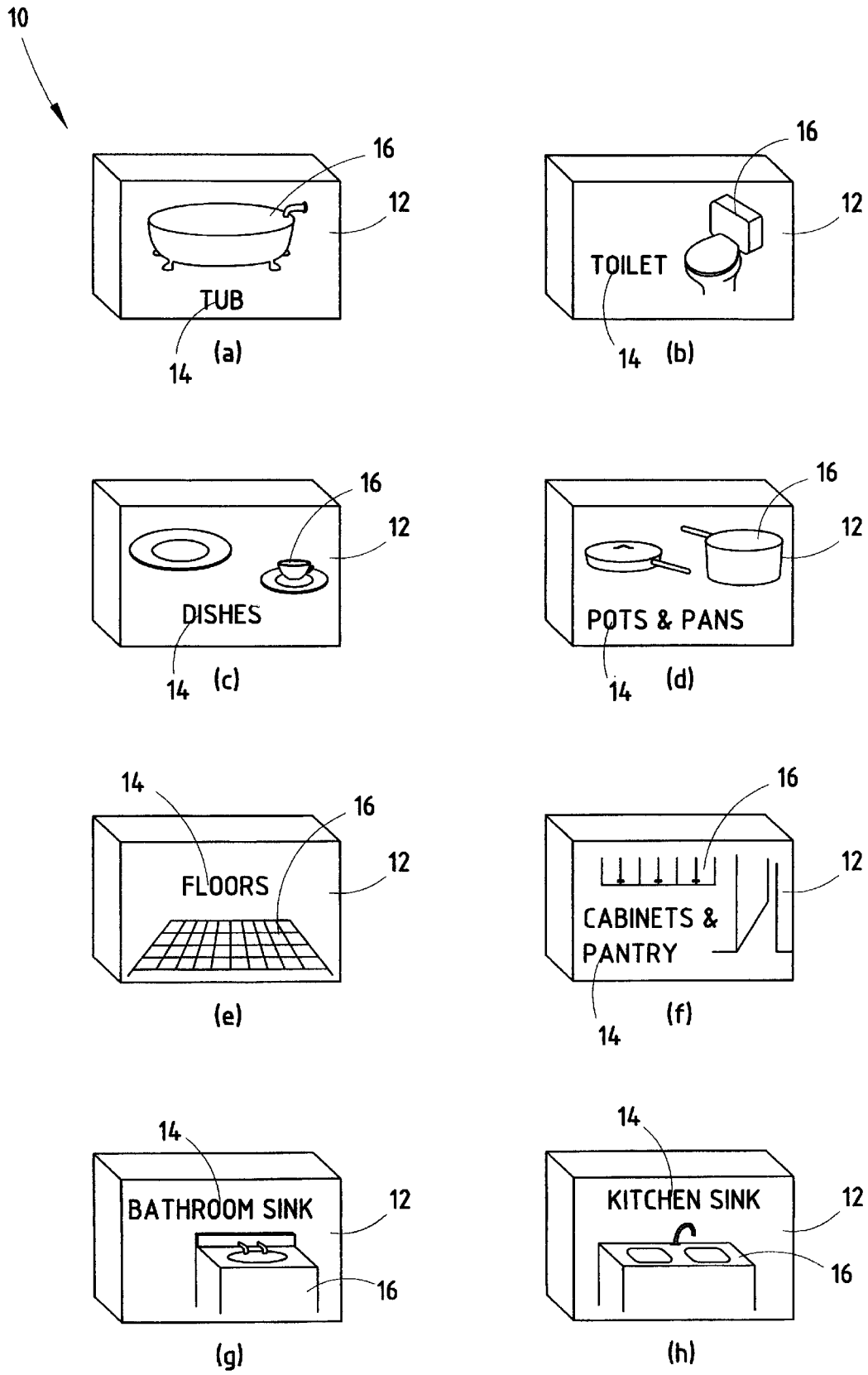
FIGS. 2(*a*)–2(*h*) are perspective views of a second embodiment of the identification system for cleaning articles according to the present invention.

An alternative embodiment is shown in FIGS. 2(*a*)–(*h*), where each of the cleaning articles 12 is provided with indicia including textual material 14 as in the indica of the first embodiment for spelling out the specific intended application in words "TUB," "TOILET," "DISHES," "POTS & PANS," "FLOORS," "CABINETS & PANTRY," "BATHROOM SINK," and "KITCHEN SINK," respectively. In addition to the textual material 14, each of the cleaning articles 12 is provided with a supplemental indica in the form of an image or symbol 16 that likewise communicates or relates to the specific intended application or the location of the specific intended application of that particular cleaning article 12.

Figure 3:
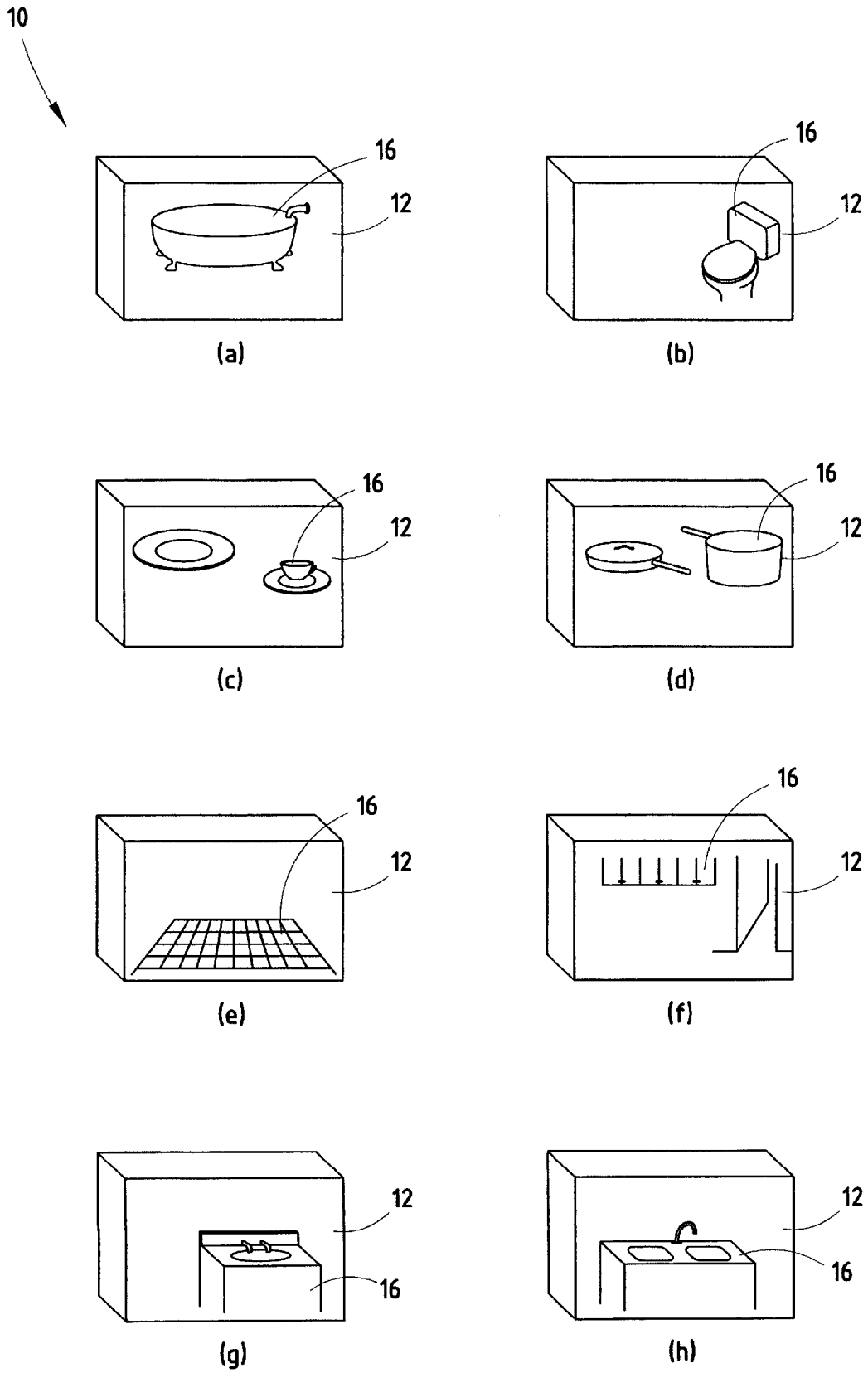
FIGS. 3(*a*)–3(*h*) are perspective views of a third embodiment of the identification system for cleaning articles according to the present invention.

A third alternative embodiment is shown in FIGS. 3(*a*)–(*h*). There, each of the cleaning articles 12 is provided with indicia taking the form of an image or symbol 16 only for indicating the specific intended application for, respectively, a bathtub, toilet, dishes, pots and pans, floors, cabinets and pantry, bathroom sink and kitchen sink. The textual material 14 is omitted, with only the image 16 indicating the specific intended application or location of the same of that particular cleaning article 12.

The indicia 14 used in the first, second and third embodiment can be of any lithographic, printed or stenciled nature, providing that the indicia be permanently or nearly permanently affixed to the cleaning article 12. For example, an indelible and nontoxic dye of a contrasting color to that of the cleaning article 12 can be used to imprint the images 16 on the cleaning articles 12 as well as the textual material 14. Other identifying approaches can also be adopted, such as using a sponge material of a contrasting color embedded into the cleaning article 12 to form the indicia 14. Similarly, a raised or embossed indica could be used to provide tactile indentification even if a printed medium is not used or has worn off, and could even be combined with Braille to assist those with visual impairment.

Figure 4:
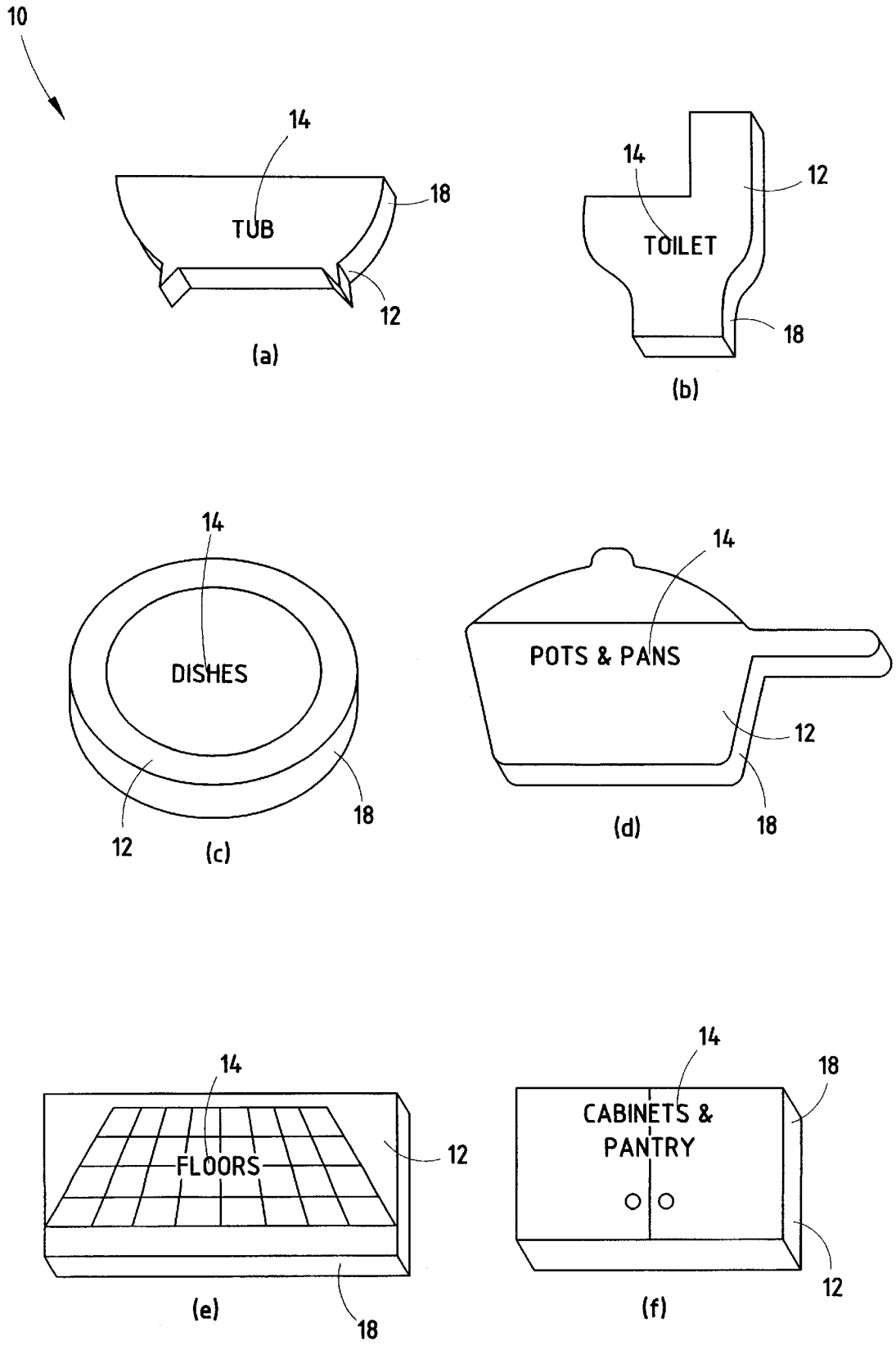
FIGS. 4(*a*)–4(*f*) are perspective views of a fourth embodiment of the identification system for cleaning articles according to the present invention.

Finally, a fourth embodiment is shown in FIGS. 4(*a*)–(*f*), where the indicia for each of the cleaning articles 12 itself forms a silhouette 18 in the shape of the intended application of the cleaning article 12. As shown in FIG. 4(*a*), the cleaning article 12 is formed in the silhouette 18 of a bathtub, indicating the specific intended application. Similarly, the cleaning articles 12 can take the shape of a toilet, dish, cooking pot, floor and cabinets and pantry. Textual material 14, while preferred, is not necessary, as the silhouette 18 serves to indicate the specific intended application of that particular cleaning article 12.

Figure 5:
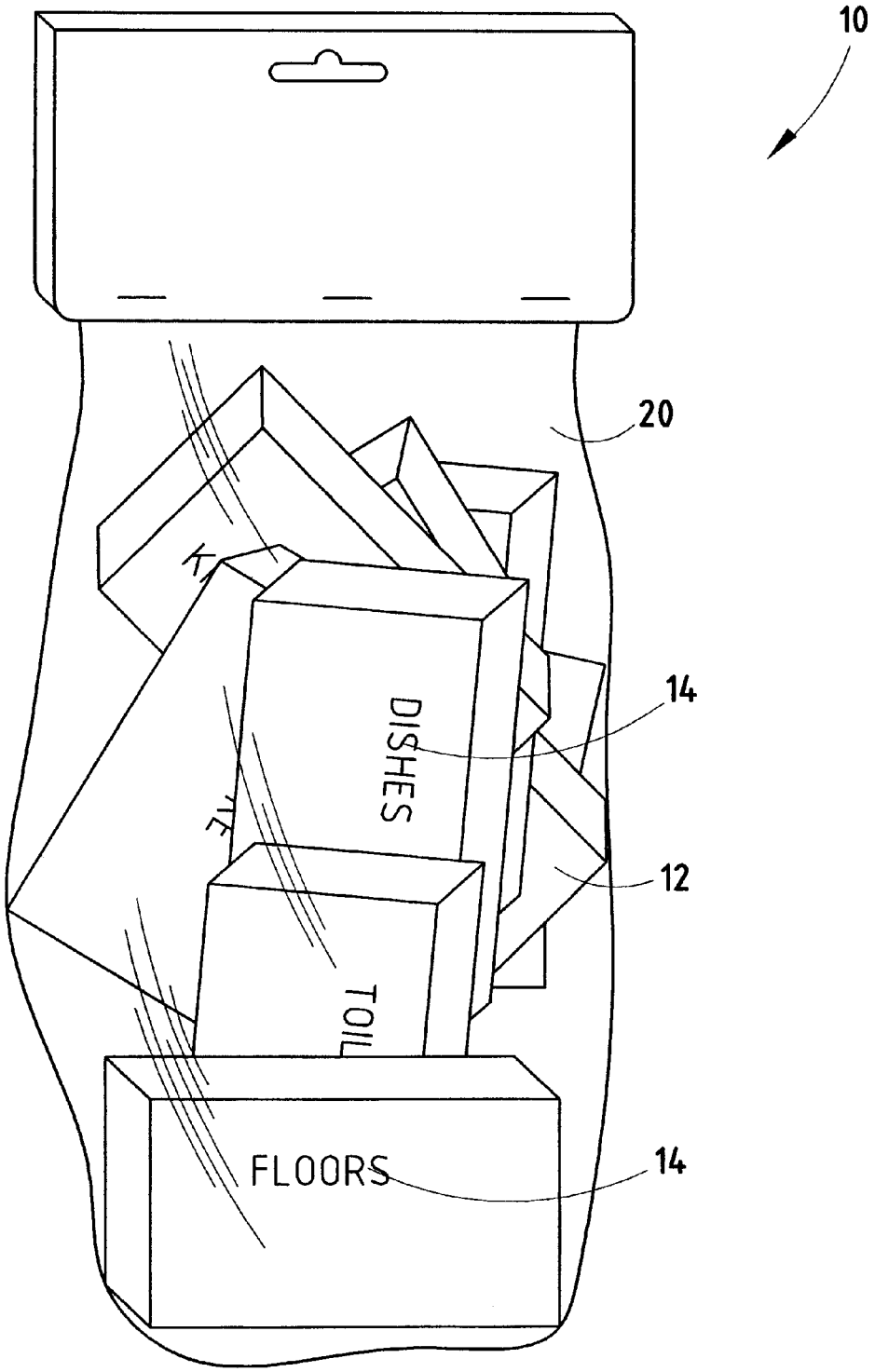
FIG. 5 is a perspective view of the packaging of the first embodiment of the identification system for cleaning articles according to the present invention.

The use of the identification system of the present invention, aside from that apparent from the above description, is preferably practiced by packaging the cleaning articles 12 such that a number of different indicia, such as textual material 14, indicating various intended applications are presented in a single package 20, as shown in FIG. 5. Thus, a purchaser can simply purchase the single package 20 and obtain a variety of cleaning articles 12, each intended for a different specific intended application. Of course, doubles or triples of cleaning articles 12 for certain intended applications, such as for cleaning dishes, that might tend to wear out sooner can be included to present greater value for the purchaser.

The advantages of the disclosed cleaning articles are attained in an economical, practical and facile manner. To wit, an identification system for identifying individual cleaning articles 12 for a specific intended application has been developed.

While embodiments of the identification system have been herein illustrated and described, it is to be appreciated that various changes, rearrangements and modifications may be made therein, without departing from the scope of the invention as defined by the appended claims.

What is claimed:

1. A method of providing distinguishable cleaning articles, wherein the cleaning articles are intended for different specific cleaning locations and each of the cleaning articles is fabricated from the group consisting essentially of wiping and absorbent devices, including sponges, wipes, towels, rags, cloths, blotters and metallic and non-metallic scrubbers, the method comprising the steps of:

assembling a plurality of cleaning articles, assigning to each of the cleaning articles an individual identifying indicia associated and corresponding with the specific intended cleaning location of the cleaning article, the indicia being distinguishable from the indicia of one or more of the others of the plurality of cleaning articles so as to facilitate visual discrimination of the cleaning article from one or more of the others of the plurality of cleaning articles, applying the indicia to the cleaning articles, wherein the individual indicia specifies the specific intended cleaning location of each of the plurality of cleaning articles and distinguishes the specific intended cleaning location of each of the plurality of cleaning articles from the specific intended cleaning location of one or more of the others of the plurality of cleaning articles; and packaging the cleaning articles in a packaging container.

* * * * *